US008068779B2

(12) United States Patent
Fowler et al.

(10) Patent No.: US 8,068,779 B2
(45) Date of Patent: Nov. 29, 2011

(54) COATED-CORE CLEANER BLADES

(75) Inventors: Jeffrey M. Fowler, Rochester, NY (US); Steven C. Hart, Williamson, NY (US); Heiko Rommelmann, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 453 days.

(21) Appl. No.: 12/241,885

(22) Filed: Sep. 30, 2008

(65) Prior Publication Data

US 2010/0080636 A1 Apr. 1, 2010

(51) Int. Cl.
*G03G 21/00* (2006.01)

(52) U.S. Cl. ..... 399/350

(58) Field of Classification Search ..... 399/350, 399/343; 15/256.5

See application file for complete search history.

(56) References Cited

U.S. PATENT DOCUMENTS

| | | | | |
|---|---|---|---|---|
| 3,936,183 | A | 2/1976 | Sadamatsu | |
| 4,332,836 | A | 6/1982 | Urban | |
| 4,970,560 | A | 11/1990 | Lindblad et al. | |
| 4,984,326 | A * | 1/1991 | Horie et al. | 15/256.5 |
| 5,778,284 | A | 7/1998 | Kumar et al. | |
| 5,888,436 | A | 3/1999 | Keith et al. | |
| 6,032,004 | A | 2/2000 | Mirabella, Jr. et al. | |
| 6,136,380 | A | 10/2000 | Suzuki et al. | |
| 6,363,237 | B1 * | 3/2002 | Nagame et al. | 399/343 |
| 6,453,146 | B1 | 9/2002 | Yamada et al. | |
| 6,547,369 | B1 | 4/2003 | Temple | |
| 6,592,796 | B2 | 7/2003 | Hill et al. | |
| 2004/0265024 | A1 * | 12/2004 | Naruse et al. | 399/350 |
| 2005/0019588 | A1 | 1/2005 | Berry et al. | |
| 2006/0216526 | A1 * | 9/2006 | Tomiyama et al. | 428/423.1 |
| 2007/0144664 | A1 | 6/2007 | Winter et al. | |
| 2008/0027184 | A1 | 1/2008 | Ueno et al. | |

FOREIGN PATENT DOCUMENTS

| | | | |
|---|---|---|---|
| JP | 04060569 A | * | 2/1992 |
| JP | 04240887 A | * | 8/1992 |
| JP | 08146809 A | * | 6/1996 |

OTHER PUBLICATIONS

Office Action Communication, Jeffrey Fowler et al., U.S. Appl. No. 12/241,863, dated Jul. 11, 2011, pp. 1-19.

* cited by examiner

*Primary Examiner* — Quana M Grainger
(74) *Attorney, Agent, or Firm* — Gibb I.P. Law Firm, LLC

(57) ABSTRACT

A coated-core cleaner blade has a core comprising a first material and a coating surrounding the core. The coating comprises a second material that is different than the first material. Further, the core (first material) is rigid compared to the coating (second material). Therefore, the first material has a first flexibility that is much less than a second flexibility of the second material.

15 Claims, 5 Drawing Sheets

COATED-CORE CLEANER BLADES

CROSS-REFERENCE TO RELATED APPLICATIONS

This application is related to co-pending U.S. patent application Ser. No. 12/241,863, entitled "Continuous Manufacturing Process For Coated-Core Cleaner Blades", by Jeffrey M. Fowler et al., filed Sep. 30, 2008, the complete disclosure of which, in its entirety, is herein incorporated by reference.

BACKGROUND AND SUMMARY

Embodiments herein generally relate to print cartridge cleaning blades, and more particularly concerns a print cartridge cleaning blade having a stiff core and a flexible covering.

Modern printing devices use inks and toners that are applied to drums and belts. Paper particles, excess toner, ink, and other foreign matter can accumulate on the various drums, rollers, belts, and augers unless such foreign matter is regularly removed. One device for removing such items from belts and drums is a flexible cleaning blade. For example, U.S. Pat. No. 5,778,284, the complete disclosure of which is incorporated herein by reference, discloses a common print cartridge cleaning blade.

In order to reduce the cost and increase the performance of print cartridge cleaning blades, the embodiments herein provide a printer or printing device (or print cartridge that is insertable into the printing device) that uses or includes a coated-core cleaner blade. The cleaner blade contacts the drum or belt (photoreceptor) to clean excess toner and foreign matter. The cleaner blade can be mounted on the same casing/frame that supports the drum or belt using a mounting bracket connected to the cleaner blade.

The coated-core cleaner blade according to embodiments herein has a core comprising a first material and a coating surrounding the core. The coating comprises a second material that is different than the first material. Further, the core (first material) is rigid relative to the coating (second material). Therefore, the first material has a first flexibility that is much less than a second flexibility of the second material. For example, the core can comprise a plastic, a ceramic, a metal, and/or an alloy, etc. Similarly, the coating can comprise a plastic, a rubber, and/or a polymer, etc.

The coating has blade edges that contact the surfaces of the belt or drum being cleaned. The core has a rectangular shape and has a length, a height perpendicular to the length, and a thickness perpendicular to the length and the height. Because it is an elongated rectangle, the length is greater in size than the thickness and the height; and the height is also greater in size than the thickness. Thus, the rectangular shape has a top, a bottom, sides, and ends. The top and bottom are rectangular planes defined by the thickness and the length. The sides are rectangular planes defined by the height and the length. The ends are rectangular planes defined by the height and the thickness.

The square corners of the core below the blade edges are located where the sides of the rectangular shape meet the top and the bottom, and the square corners run from one end to the opposite end. This shape allows the cleaner blade to have four blade edges, which permits the cleaner blade to be flipped and/or rotated to utilize a new blade edge, rather than being replaced. Therefore, this shape allows much greater service life when compared to cleaner blades with a single edge.

Further, the blade edges of the coated-core cleaner blade have a very precise edge because the outer covering follows the core to have very square corners. More specifically, because the core is formed of very rigid materials, such as metals, the core can have very square corners below the blade edges. This can result in the outer covering having blade edges that have corners with a radius that can be controlled through the manufacturing process to provide optimal cleaning performance and/or durability. The radius of the cleaner blade edges may be less than 15 microns. This allows the cleaner blade to provide increased cleaning performance and/or durability when compared to conventional cleaner blades. Further, the rigid core prevents the cleaner blade from acquiring a set or permanent bend. Therefore, the coated-core cleaner blade will perform more consistently than conventional cleaning blades that can relax the force applied against the photoreceptor over time.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
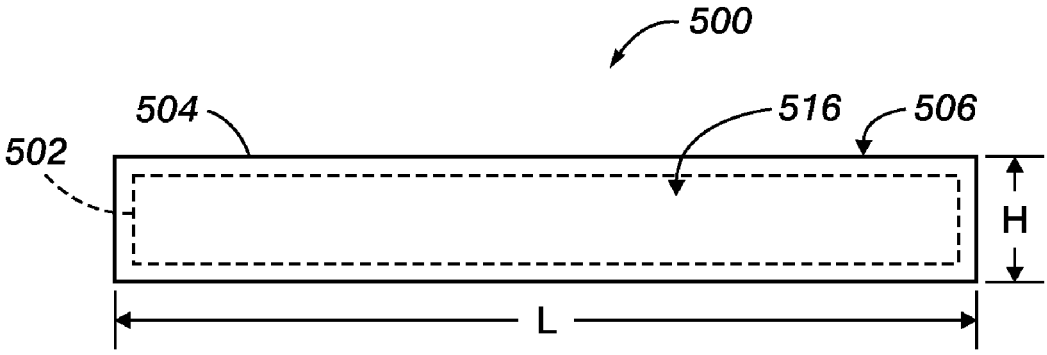
FIG. 1 is a schematic diagram of a core-coated cleaner blade according to embodiments herein.
Figure 2:
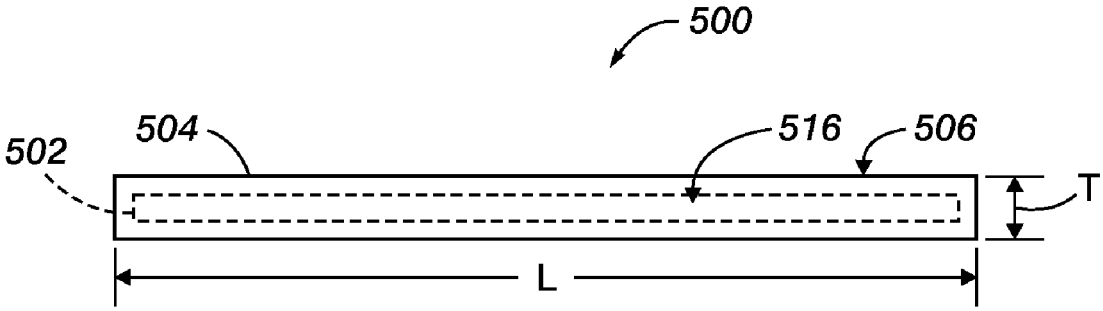
FIG. 2 is a schematic diagram of a core-coated cleaner blade according to embodiments herein.

Flexible cleaning blades (e.g., urethane) are a staple technology for cleaning photoreceptor drums and belts in electrostatic printers and copiers. In the cleaning blade itself, there are several parameters related to optimum cleaning performance: edge radius, microscopic edge uniformity (inboard to outboard), stiffness (elastic modulus), hardness (material durometer), and durability. At the cleaning blade to photoreceptor interface, there are also critical parameters related to optimum cleaning performance: overall blade load/force at the tip and the angle of attack of the tip to the photoreceptor.

Currently, in order to meet the requirements on edge sharpness and uniformity, conventional cleaning blades are spin cast as a very large diameter (approximately 1 meter) cylinder with a wall thickness of approximately 2 mm. These cylinders are then cut into strips (blades) using a knife blade (razor) which must be replaced after about every 50 to 100 cuts.

There is often a conflict between the preferred critical parameter values for optimum cleaning and maximum cleaner blade life. For example, a soft and flexible cleaner blade surface is desired to readily conform to the photoreceptor surface; however, there is a need to minimize the propensity for small localized tearing of the blade. Further, a firm and rigid cleaner blade is desired in order to achieve the desired blade load with minimum bending or flexure; however a more rigid cleaner blade will have a larger overall part thickness.

With conventionally manufactured (spin cast) urethane cleaning blades, only one side of the casting has a sufficiently smooth side to be suitable for use as a cleaning blade. This smooth side is sometimes referred to as the outside or "air side". The other side (inside) has machining (tool) marks which result in an edge that is not smooth enough to efficiently clean a photoreceptor.

As shown in FIGS. 1-4, the embodiments herein provide a coated-core cleaner blade 500. The coated-core cleaner blade according to embodiments herein has a core 502 comprising a first material and a coating 504 surrounding the core 502. The coating 504 comprises a second material that is different than the first material.

The core 502 (first material) is substantially rigid compared to the coating 504 (second material). Therefore, the first material is said to have a first flexibility that is much less than a second flexibility of the second material. For example, the elastic modulus of the core 502 can be at least five times that of the coating 504, and can be tens or hundreds times the modulus of the coating 504, depending upon the specific application.

For example, the core 502 can comprise a plastic, a ceramic, a metal, and/or an alloy, etc. To the contrary, the coating 504 can comprise a plastic, a rubber, and/or a polymer, etc. (e.g., urethane and polycarbonate, etc.). The core 502 material, potentially a metal (such as stainless steel), plastic, or other appropriate candidate, can be chosen by the designer to achieve a specific beam stiffness, depending upon the specific environment in which the cleaner blade 500 will be used.

The core 502 has a rectangular shape. Thus, the core 502 has a length (L), a height (H) perpendicular to the length, and a thickness (T) perpendicular to the length and the height. Because it is an elongated rectangle, the length is greater in size than the thickness and the height; and the height is also greater in size than the thickness. Thus, the rectangular shape has a top, a bottom, sides, and ends. The top and bottom are rectangular planes defined by the thickness and the length. The sides are rectangular planes defined by the height and the length. The ends are rectangular planes defined by the height and the thickness.

The square corners 516 of the core 502 below the blade edges 506 are located where the sides of the rectangular shape meet the top and the bottom, and the square corners 516 run from one end to the opposite end. The core 502 has "sharp" square edges (for example, the edge radius could be on the order of as small as 1 to 3 microns (or larger or smaller) depending upon material selection and designer specifications). For example, the core could be a stainless steel material manufactured with tightly controlled dimensions and with "square" edges (much in the fashion of producing razor blades).

Figure 3:
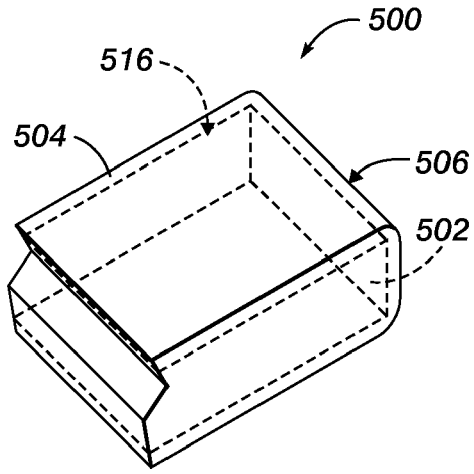
FIG. 3 is a schematic diagram of a core-coated cleaner blade according to embodiments herein.

Such sharp square corners 516 allow the coating material 504 to also have corresponding sharp corners 506, as illustrated in FIG. 3. These corners are the blade edges 506 which contact the surfaces of the belt or drum being cleaned. The coated-core cleaner blades 500 disclosed herein have very precisely designable cleaning blade edges 506 because of the sharpness of the underlying corners 516 of the core 502. A cleaning blade edge of an appropriate material and radius will provide optimal cleaning performance and/or durability. The best choices of material and cleaning blade edge geometry will depend on the design of the photoreceptor, toner, and other system parameters.

Because the rigidness of the cleaner blade 500 is supplied solely by the core 502, the coating 504 material can be chosen based solely on durability and cleaning effectiveness. Further, the coating material can be quite thin (e.g., 5 microns, 10 microns, 15 microns, 25 microns etc.). Thus, the coating 504 can be much more compliant than bulk material of conventional cleaner blades, which must compromise on other material properties because of the need to apply pressure against the photoreceptor.

Thus, the blade edges 506 of the coated-core cleaner blade 500 have a very precise square edge 506 because the outer covering 504 may be applied with a range of shapes overlying the very square corners 516 of the core 502. This allows the cleaner blade 500 to provide increased cleaning performance and/or durability when compared to conventional cleaner blades. Further, the rigid core 502 prevents the cleaner blade 500 from acquiring a set or permanent bend. Therefore, the coated-core cleaner blade 500 will perform better and more consistently than conventional cleaning blades that can relax the force applied against the photoreceptor over time.

In addition, the core 502 allows the cleaner blade 500 to have up to four blade edges 506. More specifically, the rigid core 502 allows the outer covering 504 to be applied evenly on all surfaces, avoiding the distinction between the "outside" (air side) or marked "inside" that occurs with conventional cleaner blades. Because the cleaner blade 500 has four blade edges 506, this permits the cleaner blade 500 to be flipped and/or rotated to utilize a new blade edge, rather than being replaced. Therefore, this shape allows much greater service life when compared to conventional cleaner blades that only have a single edge.

Figure 4:
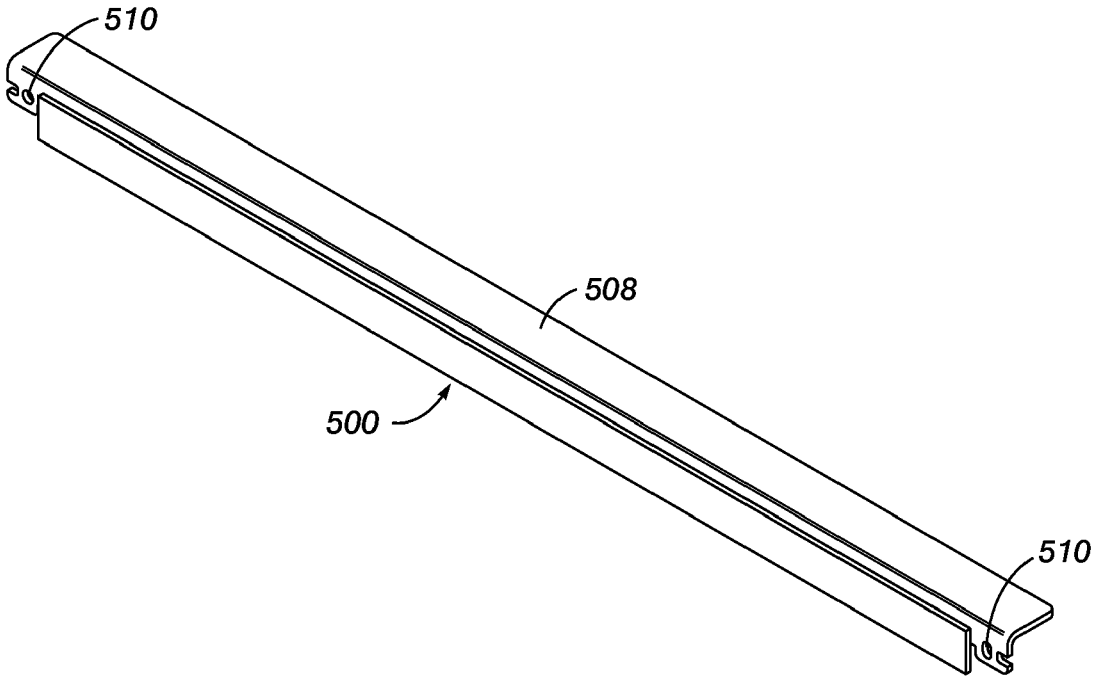
FIG. 4 is a schematic diagram of a core-coated cleaner blade according to embodiments herein.

The cleaner blade 500 can be mounted on the same casing/frame that supports the drum or belt using a mounting bracket (508 in FIG. 4) connected to the cleaner blade 500. The mounting bracket can include mounting slots, holes, pins, etc. which are illustrated in FIG. 4 as items 510. For example, the blade 500 can be mounted onto the bracket 508 with any appropriate amount (e.g., 8-12 mm) of extension (overhang). This bracket 508 is then used to locate the blade edge 506 (FIG. 3) with respect to the photoreceptor and to apply the necessary force.

Thus, as discussed above, the embodiments herein provide a cleaning blade 500 having a thin (e.g., 5 micron, 10 micron, 15 micron, 25 micron etc.), coating 504 that is applied to a thin, stiff "sharp" square edged core 502. This structure separates the functional requirements for the cleaning blade to be compliant and flexible, from those necessary for providing the blade load on the photoreceptor. Additionally, because the coating 504 is thin, the likelihood of localized tearing is significantly reduced.

As discussed in co-pending U.S. patent application Ser. No. 12/241,863, the complete disclosure of which is incorporated herein by reference, there are several manufacturing options for applying the coating 504. For example, the coating 504 can be spray coated 504 onto the core 502, either with or without electrostatic assist; the coating 504 can be powder coated onto the core 502; the coating 504 can be dip coated onto the core 504, again with or without electrostatic assist. One advantage of this structure is that all mentioned manufacturing techniques are amenable to either batch or continuous processing techniques, as described in detail in co-pending U.S. patent application Ser. No. 12/241,863. Further, as mentioned above, the rigid core 502 allows the outer covering 504 to be applied evenly on all surfaces, avoiding the distinction between the "outside" (air side) or marked "inside" that occurs with conventional cleaner blades. Because the cleaner blade 500 has four blade edges 506, this permits the cleaner blade 500 to be flipped and/or rotated to utilize a new blade edge, rather than being replaced.

Figure 5:
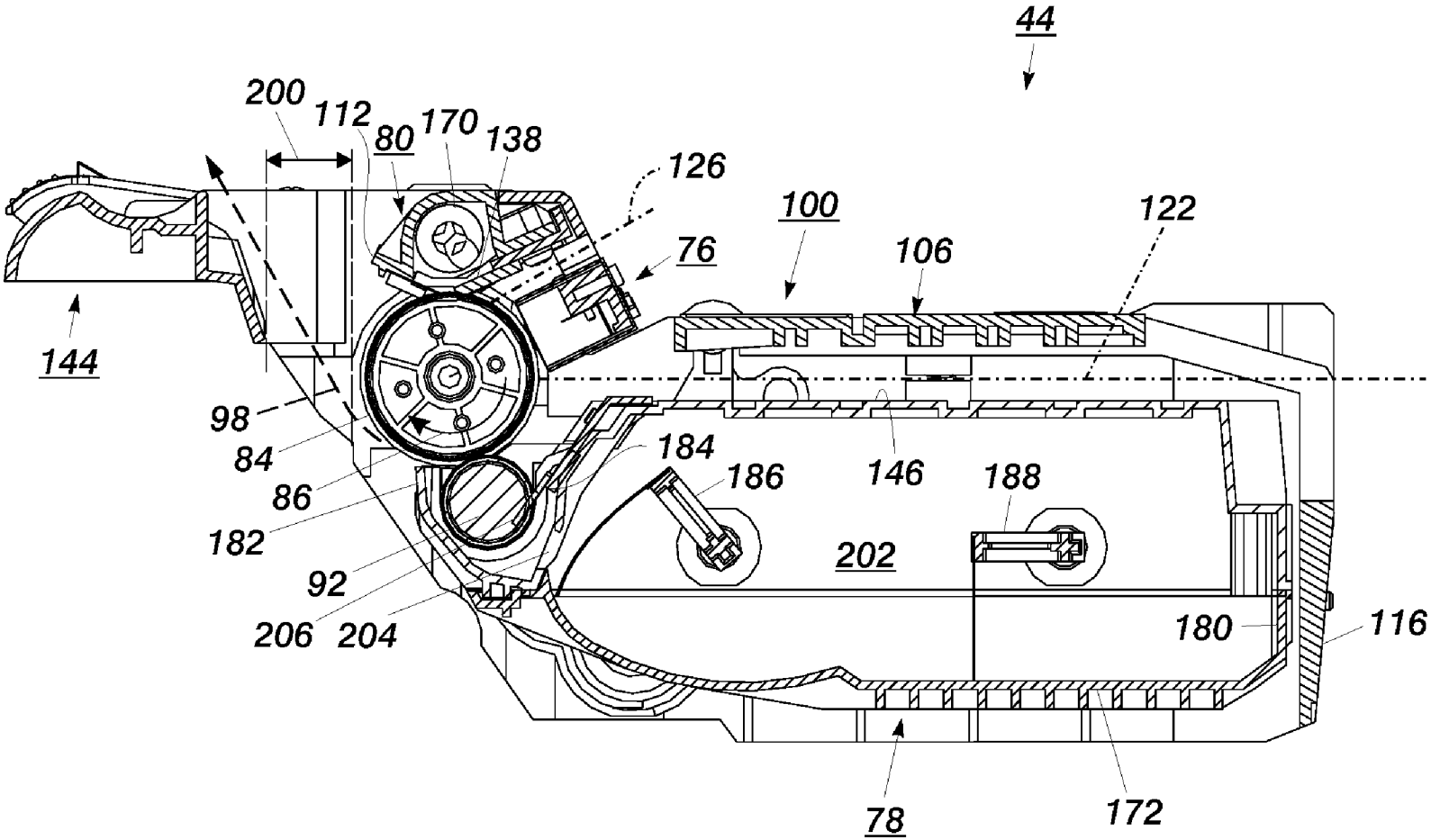
FIG. 5 is a schematic diagram of a print cartridge having a cleaning blade.
Figure 6:
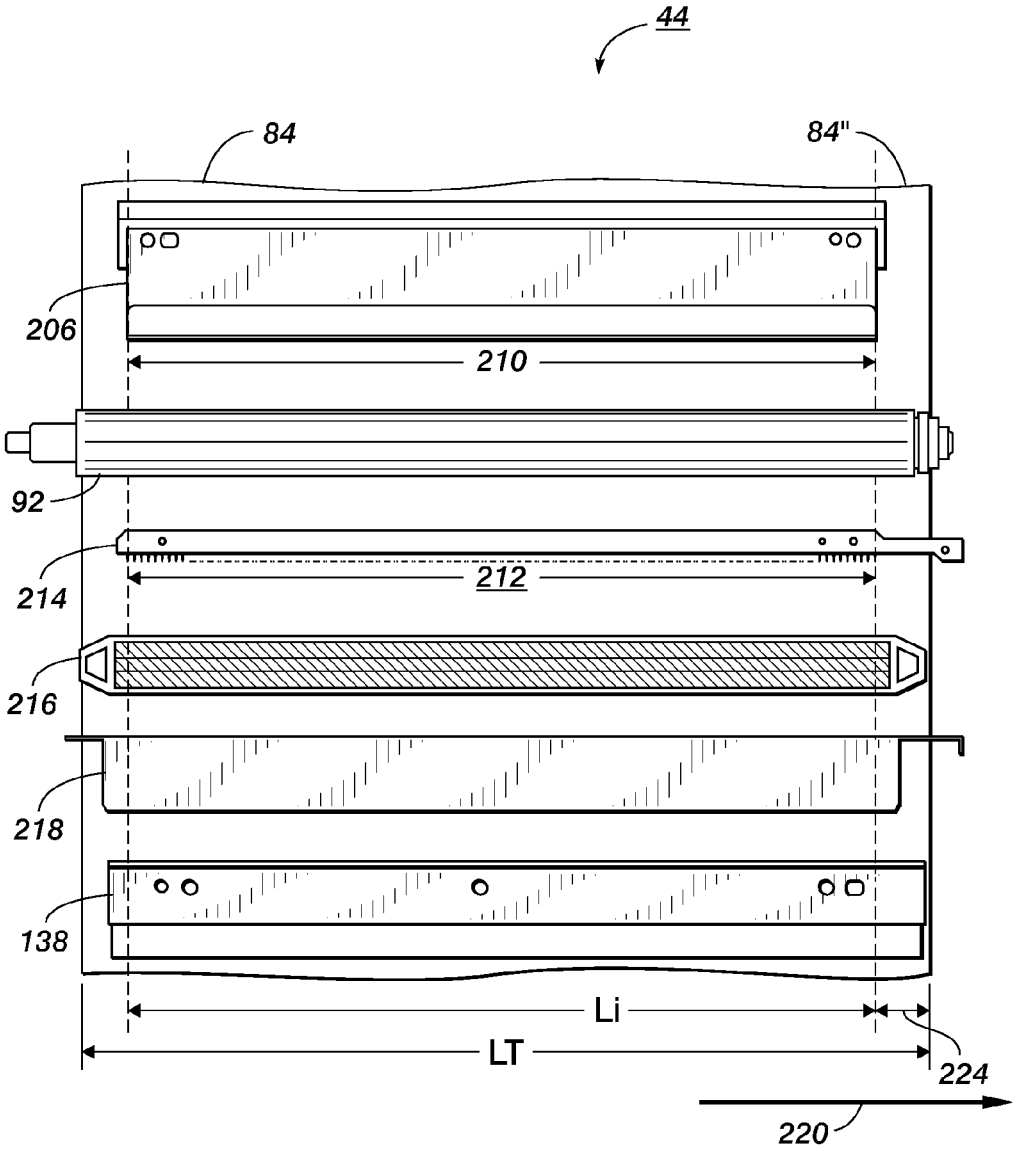
FIG. 6 is a schematic diagram of a print cartridge having a cleaning blade.

The cleaner blade 500 discussed above can be used within a printer or printing device (that is discussed below and shown in FIG. 7) or print cartridge that is insertable into the printing device (that is discussed below and shown in FIGS. 5-6). As shown in FIG. 5, the cleaner blade 500 contacts the drum or belt to clean excess toner and foreign matter.

The coated-core cleaning blades 500 can be used in many different devices. For example, FIGS. 5 and 6 illustrate the use of a cleaning blade 138 within a cartridge module. Referring specifically to FIG. 5, a vertical (front-to-back) section of the process cartridge module 44 is illustrated that is similar to the cartridge module shown in U.S. Pat. No. 5,778,284, the complete disclosure of which is incorporated herein by reference. As shown in FIG. 5, the developer subassembly 78 is mounted within the trough region of the module housing subassembly 72 as defined in part by the front end wall 116, the second side wall, and the top wall 106 of the module housing subassembly. The module handle 144 as attached to mounting members forms a portion of the sheet or paper path 98 of the machine by being spaced a distance 200 from photoreceptor 84 in the raised rear end 112 of the module housing 100. The photoreceptor or drum 84 is mounted to the side walls 102, 104, (only one of which is visible), and as shown is located within the raised rear end 112 and is rotatable in the direction of the arrow 86. The charging subassembly 76 is mounted within the second cutout in the top wall 106 and includes the slit defining part of the second light path 126 for erase light to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light. The first light path 122 is located so as to be incident onto the photoreceptor at a point downstream of the charging subassembly 76.

The front 180, top 146, rear end 182, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

In an all-in-one, discharged area development (DAD) electrostatographic process cartridge, it has been found that in order to have consistent high quality toner image development and transfer, the included electrostatographic process components must have critical acting regions relative to an imaging region on the photoreceptor, and relative to one another. Referring now to FIG. 6, the ordinarily cylindrical or drum photoreceptor or photoreceptive member 84 of the process cartridge 44 is illustrated as a split plane 84" having an overall axial length LT and an imaging length Li for short edge fed substrates or sheets. For optimal image quality reasons in a DAD process, it has been found that an acting region 210 of the charge metering blade 206 (see also FIG. 5) for charging and metering toner for development, should be centered to, and precisely only as long as the imaging length Li of the photoreceptor 84 as shown. The same is true also of the acting region 212 of the pin-array charge emitting device 214 of the charging subassembly 76 (FIG. 5) in order to avoid the occurrence of "dark bands" towards the edges of a formed and transferred image.

On the other hand, the acting regions of the developer roll 92, as well as those of a grid member 216 and of a shield member 218 both also of the charging subassembly 76, can extend slightly to either end beyond the imaging length Li, as shown. Importantly, in accordance with one aspect of the present invention, where the direction of waste toner flow is indicated by the arrow 220, the cleaning blade 138 of the cleaning subassembly 80 is not centered, but is offset as shown by a distance 224 relative to the imaging length Li, and in the direction of waste toner flow 220. The acting region of the detack device although not shown on FIG. 6, is advantageously made precisely equal to that of the pin-array charge emitting device 212 in order to avoid recharging the areas of the photoreceptor outside the imaging length Li, thus causing subsequent toner contamination.

Figure 7:
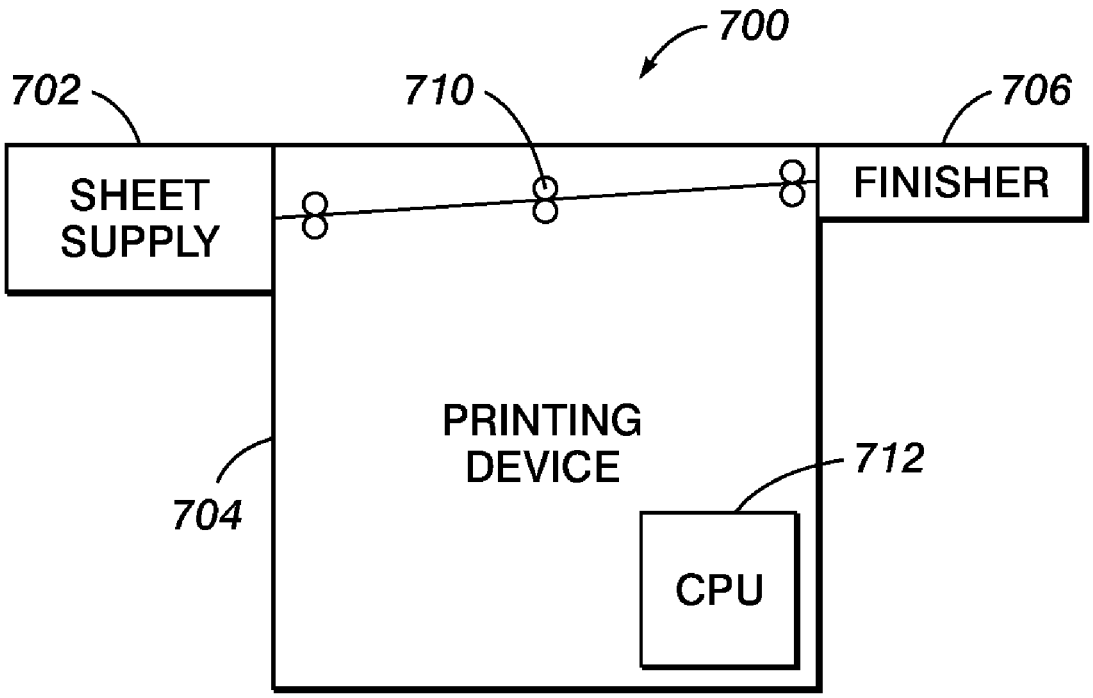
FIG. 7 is a schematic diagram of a printing device according to embodiments herein.

As shown in FIG. 7, this disclosure also presents apparatus embodiments (system 700) that include a media supply 702 that maintains the media sheets and a printing device 704 that places markings on the sheets. The apparatus can also include a finisher 706 (cutter, stapler, folder, bookmaker, etc.). Item 710 illustrates, for example, a print cartridge that can be included within the printing engine 704 and can be similar to those cartridges shown in FIGS. 5 and 6.

In addition, the printing engine 704 can include some form of processor 712 (central processing unit (CPU)) or other computerized device that can include a computer storage medium. Computerized devices that include chip-based central processing units (CPU's), input/output devices (including graphic user interfaces (GUI), memories, comparators, processors, etc. are well-known and readily available devices produced by manufactures such as International Business Machines Corporation, Armonk N.Y., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein.

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. A cleaner blade comprising:

a core comprising a first material, said core comprising square corners; and a coating surrounding said core, said coating comprising a second material different than said first material, said coating conforming to a shape of said core, said coating forming blade edges where said coating covers said square corners, said first material having a first flexibility and said second material having a second flexibility, said first flexibility being less than said second flexibility, and said blade edges comprising up to four distinct blade edges that contact surfaces being cleaned.

2. The cleaner blade according to claim 1, said square corners having a radius of less than 15 microns.

3. The cleaner blade according to claim 1, said core having a rectangular shape, said rectangular shape having a length, a height perpendicular to said length, and a thickness perpendicular to said length and said height, said length having a greater size than said thickness and said height, and said height having a greater size than said thickness, said rectangular shape having a top, a bottom, sides, and ends, said top and bottom comprising rectangular planes defined by said thickness and said length, said sides comprising rectangular planes defined by said height and said length, and said ends comprising rectangular planes defined by said height and said thickness, said square corners being located where said sides meet said top and said bottom, and said square corners running from one of said ends to an opposite end.

4. The cleaner blade according to claim 1, said core comprising at least one of a plastic, a ceramic, a metal, and an alloy, and said coating comprising at least one of a plastic, a rubber, and a polymer.

5. A print cartridge module comprising:

a frame;

a photoreceptor connected to said frame; and a cleaner blade contacting said photoreceptor, said cleaner blade comprising:

a core comprising a first material, said core comprising square corners;

a coating surrounding said core, said coating comprising a second material different than said first material, said coating forming blade edges where said coating covers said square corners; and a mounting bracket connected to said core, said mounting bracket connecting to said frame, said first material having a first flexibility and said second material having a second flexibility, said first flexibility being less than said second flexibility, and said blade edges comprising up to four distinct blade edges that contact surfaces being cleaned.

6. The print cartridge module according to claim 5, said square corners having a radius of less than 15 microns.

7. The print cartridge module according to claim 5, said core having a rectangular shape, said rectangular shape having a length, a height perpendicular to said length, and a thickness perpendicular to said length and said height, said length having a greater size than said thickness and said height, and said height having a greater size than said thickness, said rectangular shape having a top, a bottom, sides, and ends, said top and bottom comprising rectangular planes defined by said thickness and said length, said sides comprising rectangular planes defined by said height and said length, and said ends comprising rectangular planes defined by said height and said thickness, said square corners being located where said sides meet said top and said bottom, and said square corners running from one of said ends to an opposite end.

8. The print cartridge module according to claim 5, said core comprising at least one of a plastic, a ceramic, a metal, and an alloy, and said coating comprising at least one of a plastic, a rubber, and a polymer.

9. A printing device comprising:

a frame;

a printing engine connected to said frame;

a photoreceptor connected to said frame; and a cleaner blade contacting said photoreceptor, said cleaner blade comprising:

a core comprising a first material, said core comprising square corners;

a coating surrounding said core, said coating comprising a second material different than said first material, said coating forming blade edges where said coating covers said square corners; and a mounting bracket connected to said core, said mounting bracket connecting to said frame, said first material having a first flexibility and said second material having a second flexibility, said first flexibility being less than said second flexibility, and said blade edges comprising up to four distinct blade edges that contact surfaces being cleaned.

10. The printing device according to claim 9, said square corners having a radius of less than 15 microns.

11. The printing device according to claim 9, said core having a rectangular shape, said rectangular shape having a length, a height perpendicular to said length, and a thickness perpendicular to said length and said height, said length having a greater size than said thickness and said height, and said height having a greater size than said thickness, said rectangular shape having a top, a bottom, sides, and ends, said top and bottom comprising rectangular planes defined by said thickness and said length, said sides comprising rectangular planes defined by said height and said length, and said ends comprising rectangular planes defined by said height and said thickness, said square corners being located where said sides meet said top and said bottom, and said square corners running from one of said ends to an opposite end.

12. The printing device according to claim 9, said core comprising at least one of a plastic, a ceramic, a metal, and an alloy, and said coating comprising at least one of a plastic, a rubber, and a polymer.

13. The cleaner blade according to claim 1, said blade edges overlying said square corners, and a shape of said blade edges conforming to a shape of said square corners.

14. The print cartridge module according to claim 5, said blade edges overlying said square corners, and a shape of said blade edges conforming to a shape of said square corners.

15. The printing device according to claim 9, said blade edges overlying said square corners, and a shape of said blade edges conforming to a shape of said square corners.

* * * * *